US010002588B2

(12) United States Patent
Chen et al.

(10) Patent No.: US 10,002,588 B2
(45) Date of Patent: Jun. 19, 2018

(54) ELECTRONIC PAPER DISPLAY DEVICE

(71) Applicant: Microsoft Technology Licensing, LLC, Redmond, WA (US)

(72) Inventors: Nicholas Yen-Cherng Chen, Cambridge (GB); James Scott, Cambridge (GB); Stephen Edward Hodges, Cambridge (GB); John Franciscus Marie Helmes, Steyl (NL); Stuart Taylor, Cambridge (GB); Thomas Robert Kubitza, Stuttgart (DE); Sergey Antonovich, Chekhov (RU); Refael Zabdi Whyte, Hamilton (NZ); Nicolas Villar, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 63 days.

(21) Appl. No.: 14/664,689

(22) Filed: Mar. 20, 2015

(65) Prior Publication Data

US 2016/0275880 A1 Sep. 22, 2016

(51) Int. Cl.

| | |
|---|---|
| ***G09G 5/00*** | (2006.01) |
| ***G09G 5/12*** | (2006.01) |
| ***G09G 3/34*** | (2006.01) |

(52) U.S. Cl.

CPC ..... *G09G 5/12* (2013.01); *G09G 3/34* (2013.01); *G09G 5/003* (2013.01); *G09G 2380/14* (2013.01)

(58) Field of Classification Search

CPC .... G09G 3/3433; G09G 3/007; G09G 3/2092; G09G 5/003; G09G 5/12; G09G 2330/021

See application file for complete search history.

(56) References Cited

U.S. PATENT DOCUMENTS

| | | | |
|---|---|---|---|
| 6,906,705 | B2 | 6/2005 | Matsuo et al. |
| 7,679,627 | B2 | 3/2010 | Sampsell et al. |
| 7,865,734 | B2 | 1/2011 | Jung et al. |
| 7,920,112 | B2 | 4/2011 | Kurihara et al. |

(Continued)

FOREIGN PATENT DOCUMENTS

| | | | |
|---|---|---|---|
| CN | 102314355 | A | 1/2012 |
| JP | 2005172843 | A | 6/2005 |

(Continued)

OTHER PUBLICATIONS

Swedberg, Claire, "Researchers Develop Energy-Harvesting NFC Tag With Sensors, E-Paper Display", Jan. 16, 2015, Available at: http://www.rfidjournal.com/articles/view210941/2.

(Continued)

*Primary Examiner* — Peter D Mcloone

(57) ABSTRACT

A display device is described that comprises an electronic paper display but that does not include a power source that is capable of providing sufficient power to update the electronic paper display. Instead, the electronic paper display can only be updated when receiving external power via a digital data and power bus. The bus also provides pixel data for content to be displayed on the electronic paper display and at least one externally generated bias voltage level for the electronic paper display. The display device further comprises a processor that configured to drive the electronic paper display.

20 Claims, 10 Drawing Sheets

(56) References Cited

U.S. PATENT DOCUMENTS

| | | | | |
|---|---|---|---|---|
| 7,990,338 | B2 | 8/2011 | Teng et al. | |
| 8,002,191 | B2 | 8/2011 | Lane | |
| 8,050,515 | B2 | 11/2011 | Chen | |
| 8,203,547 | B2 | 6/2012 | Erol et al. | |
| 8,213,987 | B2 | 7/2012 | Takizuka et al. | |
| 8,390,456 | B2 | 3/2013 | Puleston et al. | |
| 8,418,926 | B2 | 4/2013 | Chen et al. | |
| 8,527,338 | B2 | 9/2013 | Lin | |
| 8,566,848 | B2 | 10/2013 | Teng et al. | |
| 8,629,814 | B2 | 1/2014 | Teng et al. | |
| 8,648,858 | B1 | 2/2014 | Swenson et al. | |
| 8,681,091 | B2 | 3/2014 | Lai et al. | |
| 2003/0132924 | A1 | 7/2003 | Hamilton | |
| 2003/0156090 | A1 | 8/2003 | Munn et al. | |
| 2003/0160767 | A1 | 8/2003 | Wong et al. | |
| 2004/0008179 | A1 | 1/2004 | Chung et al. | |
| 2005/0122306 | A1 | 6/2005 | Wilcox et al. | |
| 2005/0280627 | A1* | 12/2005 | Koshimizu | B41J 3/4076 345/156 |
| 2006/0077127 | A1* | 4/2006 | Sampsell | G09G 3/3466 345/55 |
| 2006/0170648 | A1 | 8/2006 | Zhou et al. | |
| 2007/0247422 | A1 | 10/2007 | Vertegaal et al. | |
| 2008/0273796 | A1 | 11/2008 | Kansai et al. | |
| 2010/0060566 | A1 | 3/2010 | Wang et al. | |
| 2010/0073263 | A1 | 3/2010 | Cohen et al. | |
| 2010/0227651 | A1* | 9/2010 | Kim | G06F 3/1423 455/566 |
| 2011/0072076 | A1 | 3/2011 | Stefani et al. | |
| 2011/0241843 | A1 | 10/2011 | Marsanne et al. | |
| 2012/0042371 | A1 | 2/2012 | Gur et al. | |
| 2012/0127063 | A1 | 5/2012 | Ohno et al. | |
| 2012/0169754 | A1 | 7/2012 | Pesonen et al. | |
| 2012/0200610 | A1 | 8/2012 | Sakamoto et al. | |
| 2012/0220220 | A1 | 8/2012 | DeLuca et al. | |
| 2013/0044215 | A1 | 2/2013 | Rothkopf et al. | |
| 2013/0106805 | A1 | 5/2013 | Forster | |
| 2013/0124480 | A1 | 5/2013 | Chua et al. | |
| 2013/0133023 | A1 | 5/2013 | Burstein et al. | |
| 2013/0133088 | A1 | 5/2013 | Gunadisastra et al. | |
| 2013/0143651 | A1 | 6/2013 | Harrison et al. | |
| 2014/0055802 | A1* | 2/2014 | Otake | B41J 3/4076 358/1.13 |
| 2014/0064694 | A1 | 3/2014 | Zealer | |
| 2014/0139500 | A1* | 5/2014 | Kimura | G09G 5/12 345/204 |
| 2014/0181691 | A1 | 6/2014 | Poornachandran et al. | |
| 2014/0184471 | A1 | 7/2014 | Martynov et al. | |
| 2014/0191926 | A1 | 7/2014 | Mathew et al. | |
| 2014/0283016 | A1 | 9/2014 | Sambamurthy et al. | |
| 2015/0268830 | A1* | 9/2015 | Martynov | G09G 3/20 715/766 |

FOREIGN PATENT DOCUMENTS

| | | | |
|---|---|---|---|
| JP | 2010288187 | A | 12/2010 |
| WO | 2013126711 | A1 | 8/2003 |
| WO | 2010102835 | A1 | 9/2010 |
| WO | 2014027187 | A1 | 2/2014 |
| WO | 2014049425 | A1 | 4/2014 |

OTHER PUBLICATIONS

"Driving Electronic Paper Displays (E-Paper)", In Technical Document, Jan. 16, 2015, 20 pages.

Boden, Rian, "British Airways to offer NFC Luggage Tags", Published on: Jul. 3, 2013, Available at: http://www.nfcworld.com/2013/07/03/324876/british-airways-to-offer-nfc-luggage-tags/.

Swedberg, Claire, "Researchers Develop Energy-Harvesting NFC Tag with Sensors, E-Paper Display", Published on: Aug. 22, 2013, Available at: http://www.rfidjournal.com/articles/view210941.

"What Is Smart Tag?", Jan. 16, 2015, Available at: http://www.rfidjournal.com/articles/view?10941.

"Notice Boards that actually Tell You What You Need to Know, When You Need to Know It", Nov. 20, 2014, Available at: http://www.visionect.com/blog/notice-boards-that-actually-tell-you-what-you-need-to-know/.

Malik, et al., "Energy Harvested Electronic Shelf Label", Jan. 16, 2015, http://www.st.com/st-web-ui/static/active/en/resource/sales_and_marketing/promotional_material/magazine/ENERGY%20HARVESTED%20ELECTRONIC%20SHELF%20LABEL.pdf.

Ho, Raymond, "Solomon Systech Drivers Enable Bistable Display", Published on: Aug. 15, 2011, Available at: systech.com/files/ck/files/Technical%20Articles/Bistable/%20Display_2007Apr.pdf.

"E Ink_ Concept Showcase_ Smartphone Battery Case by Lenart Studios", Published on: Jan. 12, 2012, Available at: http://www.eink.com/concept_showcase_smartphone_case.html.

Chen, et al., "Designing a Multi-slate Reading Environment to Support Active Reading Activities", In Journal of ACM Transactions on Computer-Human Interaction, vol. 19, Issue 3, Oct. 2012, 35 pages.

Tarun, et al., "PaperTab: An Electronic Paper Computer with Multiple Large Flexible Electrophoretic Displays", In Proceedings of Extended Abstracts on Human Factors in Computing Systems, Apr. 27, 2013, 4 pages.

Gomes, et al., "Paperfold, A Novel Shape Changing Mobile Device with Multiple Reconfigurable touch Sensitive Thinfilm Electrophoretic Magnetic Display Tiles", In Proceedings of Extended Abstracts on Human Factors in Computing Systems, Apr. 26, 2014, 4 pages.

Dementyev, et al., "Wirelessly Powered Bistable Display Tags", In Proceedings of the ACM international joint conference on Pervasive and ubiquitous computing, Sep. 8, 2013, 4 pages.

"A Better Way to Read and Write", Published on: Mar. 27, 2014 Available at: https://pro.sony.com/bbsc/ssr/show-digitalpaper/resource.solutions.bbsccms-assets-show-digitalpaper-digitalpaper.shtml?PID=I:digitalpaper:digitalpaper.

Khalilbeigi, et al., "Xpaaand: Interaction Techniques for Rollable Displays", In Proceedings of the SIGCHI Conference on Human Factors in Computing Systems, May 7, 2011, 4 pages.

"Near Field Communication at Vanguard", Published on: Nov. 6, 2013 Available at: http://www.vanguardid.com/NearFieldCommunication.aspx.

Campbell, Mikey, "Apple's Patented Flexible Device Display Triggers Data Events Through Bending", Published on: Oct. 7, 2014 Available at: http://appleinsider.com/articles/14/10/07/apples-patented-flexible-device-display-triggers-data-events-through-bending.

Maqsood, et al., "POSTER: Passwords on Flexible Display Devices", In Proceedings of the ACM SIGSAC conference on Computer & communications security, Nov. 4, 2013, 3 pages.

Chung et al., "A Cloud-Powered Driver-Less Printing System for Smartphones", In Proceedings of the ACM International Joint Conference On Pervasive And Ubiquitous Computing, Sep. 8, 2013 10 pages.

"Bi-stable Cholesteric Displays", Nov. 19, 2014 Available at: http://www.varitronix.conn/product/index.php?option=com_content&view=article&id=40&Itemid=64.

"Neolux Ink-in-Motion Solar Powered E-Paper", Nov. 27, 2014 Available at: http://www.neoluxiim.com/english/sub/products_08.php.

"AIOI Systems—Smart Tags", Nov. 27, 2014 Available at: http://aioismarttag.com/specification.php.

"Omni-ID e-ink based tags", Nov. 27, 2014 Available at: http://www.omni-id.com/pdfs/Omni-ID_View_Tags_datasheet.pdf.

Carter, et al., "Digital Graffiti: Public Annotation of Multimedia Content", In Proceedings of Conference on Human Factors in Computing Systems, Apr. 24, 2004, 4 pages.

Oat, et al., "MoCHA: Augmenting Pervasive Displays through Mobile Devices and Web-based Technologies", In Proceedings of First Workshop on Developing Applications for Pervasive Display Networks, Mar. 24, 2014, pp. 506-511.

Tofel, Kevin C., "4. Whoa: NFC can be Used to Power an E Ink Display without Wires!", Published on: Aug. 19, 2013 Available at: https://gigaom.com/2013/08/19/whoa-nfc-can-be-used-to-poweran-e-ink-display-without-wires/.

(56) References Cited

OTHER PUBLICATIONS

Francesco, Mario Di, "Mario Di Francesco _ Smart Screens", Jan. 16, 2015 Available at: http://www.uta.edu/faculty/mariodf/research/smart-screens.html.
Wen, et al., "Support for Power Efficient Mobile Video Playback on Simultaneous Hybrid Display", In IEEE 10th Symposium on Embedded Systems for Real-time Multimedia, Oct. 11, 2012, 10 pages.
Kunze, et al., "Annotate Me: Supporting Active Reading using Real-Time Document Image Retrieval On Mobile Devices", In Proceedings of ACM Conference on Pervasive and Ubiquitous Computing Adjunct Publication, Sep. 8, 2013, pp. 231-234.
Mlot, Stephanie, "Sony Reveals $1,100 Digital Paper Slate", Published on: Mar. 31, 2014 Available at: http://www.pcmag.com/article2/0,2817,2455696,00.asp.
Collins, Barry, "enTourage eDGe: The Dual-Screen eBook Reader", Published on: Jan. 6, 2010 Available at: http://www.pcpro.co.uk/blogs/2010/01/06/entourage-edge-the-dual-screen-ebook-reader.
Davies, et al., "Personalisation and Privacy in Future Pervasive Display Networks", In Proceedings of SIGCHI Conference on Human Factors in Computing Systems, Apr. 26, 2014, pp. 2357-2366.
Yamada, Kannon, "The Best Four E-Paper Displays Coming To Your Smartphone and Tablet", Published on: Sep. 17, 2013, Available at: http://www.makeuseof.com/tag/the-best-four-e-paper-displays-coming-to-your-smartphone-and-tablet/.
Chen, et al., "cTPM: A Cloud TPM for Cross-Device Trusted Applications", In Proceedings of 11th USENIX Conference on Networked Systems Design and Implementation, Apr. 2, 2014, 15 page.
Achemlal, et al., "Trusted Platform Module as an Enabler for Security in Cloud Computing", In Proceedings of Conference on Network and Information Systems Security, May 18, 2011, 6 page.
Zhuang, et al., "A Novel Architecture for Trusted Computing on Public Endpoints", In Proceedings of Second International Conference on Networks Security Wireless Communications and Trusted Computing, vol. 2, Apr. 24, 2010, pp. 232-235.
plastc.com/card:The Intelligent way to pay, Feb. 13, 2015 Available at: https://www.plastc.com/card.
techcrunch.com: Coin Demoes The Tech That Scored A $15.5M Round Led By Red Point, May 5, 2014 Available at: http://techcrunch.com/2014/05/05/coin-demoes-the-tech-that-scored-a-15-5m-round-led-by-red-point/#.
techcrunch.com: Plastc Launches A Coin Competitor As The Smart Card Market Heats Up, Oct. 7, 2014 Available at: http://techcrunch.com/2014/10/07/plastc-launches-a-coin-competitor-as-the-smart-card-market-heats-up/.
"International Search Report and Written Opinion Issued in PCT Application No. PCT/US2016/022520", dated Sep. 2, 2016,17 Pages.
"Second Written Opinion Issued in PCT Patent Application No. PCT/US2016/022520", dated Jan. 31, 2017, 9 Pages.
"International Preliminary Report on Patentability issued in PCT Application No. PCT/US2016/022520", dated Jun. 16, 2017, 10 Pages.
"International Preliminary Report on Patentability Issued in PCT Application No. PCT/US2016/022520", dated Aug. 30, 2017, 10 Pages.

* cited by examiner

ELECTRONIC PAPER DISPLAY DEVICE

BACKGROUND

Electronic paper (or e-paper) is commonly used for e-reader devices because it only requires power to change the image displayed and does not require continuous power to maintain the display in between. The electronic paper can therefore hold static images or text for long periods of time (e.g. from several minutes to several hours and even several days, months or years in some examples) without requiring significant power (e.g. without any power supply or with only minimal power consumption). There are a number of different technologies which are used to provide the display, including electrophoretic displays, electrochromic and electro-wetting displays. Many types of electronic paper display are also referred to as 'bi-stable' displays because they use a mechanism in which a pixel can move between stable states (e.g. a black state and a white state) when powered but holds its state when power is removed.

SUMMARY

The following presents a simplified summary of the disclosure in order to provide a basic understanding to the reader. This summary is not intended to identify key features or essential features of the claimed subject matter nor is it intended to be used to limit the scope of the claimed subject matter. Its sole purpose is to present a selection of concepts disclosed herein in a simplified form as a prelude to the more detailed description that is presented later.

A display device is described that comprises an electronic paper display but that does not include a power source that is capable of providing sufficient power to update the electronic paper display. Instead, the electronic paper display can only be updated when receiving external power via a digital data and power bus. The bus also provides pixel data for content to be displayed on the electronic paper display and at least one externally generated bias voltage level for the electronic paper display. The display device further comprises a processor that configured to drive the electronic paper display.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
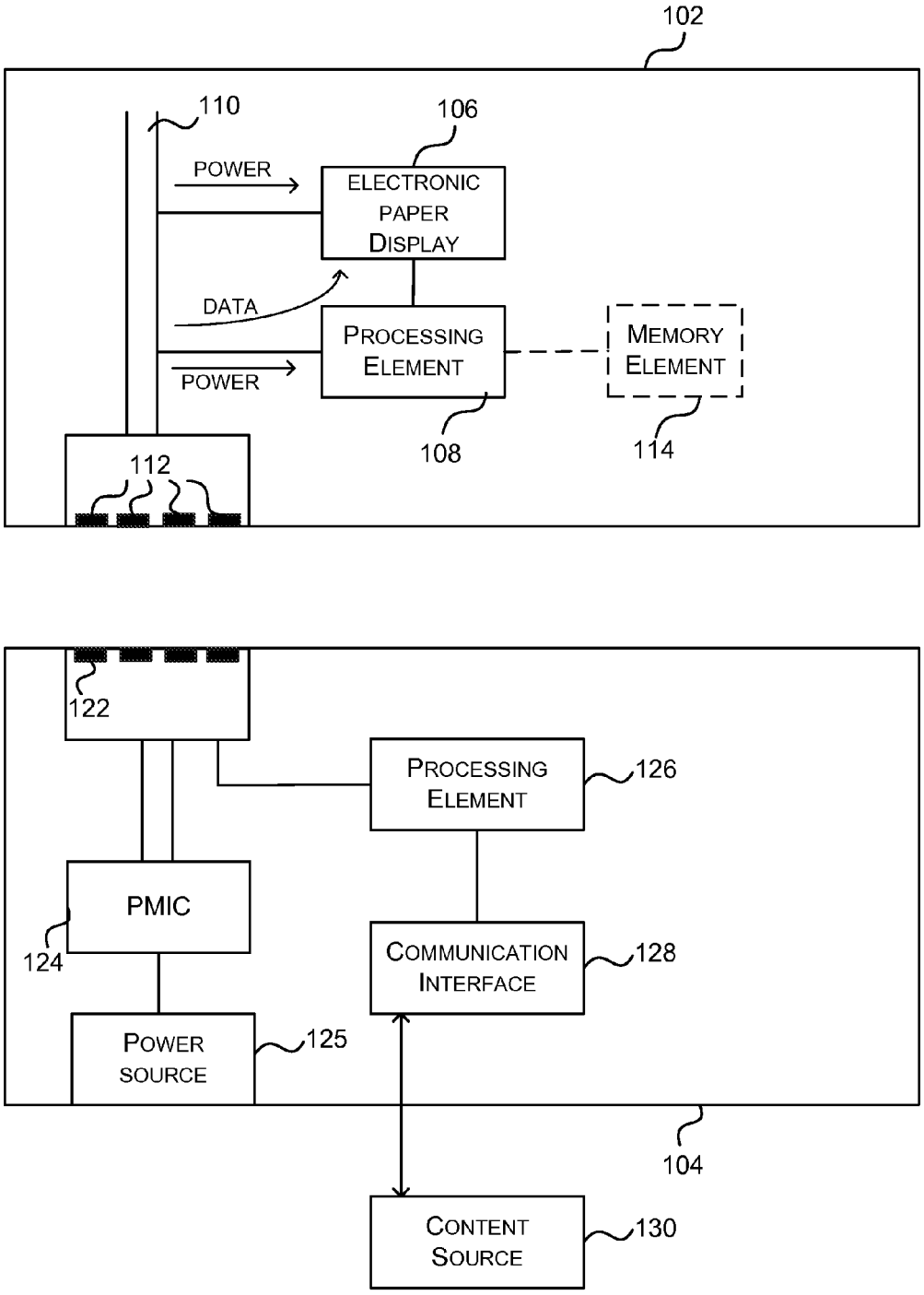
FIG. 1 is a schematic diagram of an example display device and printer device.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

E-reader devices often use a bi-stable display because they have much lower power consumption than backlit liquid crystal displays (LCDs) or LED displays which require power to be able to display content. In contrast, a bi-stable display requires power to change state (i.e. change the image/text displayed) but does not require power to maintain a static display. However, despite the difference in display technologies used by e-reader devices, which typically employ bi-stable displays, and tablet computers, which typically employ LCDs or LED displays, the hardware architecture of e-readers and tablet computers is very similar. Both types of device contain a battery, a processor, a wired or wireless communications module and user interaction hardware (e.g. to provide a touch-sensitive screen and one or more physical controls such as buttons).

The embodiments described below are not limited to implementations that solve any or all of the disadvantages of known display devices.

Described herein is a display device which comprises an electronic paper display but which does not include a battery (or other power source) which provides sufficient power to update the electronic paper display; instead, the electronic paper display is only updatable when power is provided via a contact based conductive digital data and power bus (and hence this power may be referred to as 'external' power). This bus provides the pixel data for the display to a processing element (or processor) in the display device. The processing element drives the electronic paper display and only updates the electronic paper display when receiving power via the bus from a power supply external to the display device.

The term 'electronic paper' is used herein to refer to display technologies which reflect light (like paper) instead of emitting light like conventional LCD displays. As they are reflective, electronic paper displays do not require a significant amount of power to maintain an image on the display and so may be described as persistent displays. A multi-stable display is an example of an electronic paper display. In some display devices, an electronic paper display may be used together with light generation in order to enable a user to more easily read the display when ambient light levels are too low (e.g. when it is dark). In such examples, the light generation is used to illuminate the electronic paper display to improve its visibility rather than being part of the image display mechanism and the electronic paper does not require light to be emitted in order to function.

The term 'multi-stable display' is used herein to describe a display which comprises pixels that can move between two or more stable states (e.g. a black state and a white state and/or a series of grey or colored states). Bi-stable displays, which comprise pixels having two stable states, are therefore examples of multi-stable displays. A multi-stable display can be updated when powered, but holds a static image when not powered and as a result can display static images for long periods of time with minimal or no external power. Consequently, a multi-stable display may also be referred to as a 'persistent display' or 'persistently stable' display.

The electronic paper displays described herein are reflective bit-mapped/pixelated displays that provide display elements, such as pixels, to enable arbitrary content to be displayed.

In various examples, the display devices 106 described below may be described as 'non-networked displays' because whilst they can maintain an image without requiring significant power, they have no automatic means of updating their content other than via the method described herein.

Such a display device (that comprises an electronic paper display) can be very thin and light (e.g. due to the lack of battery that provides sufficient power to update the electronic paper display) and depending upon the electronic paper display technology used, can also be flexible. The display can, for example, be used to display data that is required for a period of time and unlike a tablet computer or smartphone, the user does not need to worry that the data (which may, for example, be an image of boarding card or train ticket) will be lost when an internal battery runs down.

The digital data and power bus is described as being contact based and conductive because signals for the digital data and power bus are not provided via a cable (that may be flexible), but instead the display device comprises a plurality of conductive contacts (e.g. metal contacts) on its housing (e.g. on an exterior face of the housing) that can be contacted against a corresponding set of conductive contacts on the housing of a 'printer device'. For example, the plurality of conductive contacts may be on a visible face of the display device (e.g. the front, back or side of the printer device) and may be contacted against a corresponding set of conductive contacts on a visible face of the printer device or within a recess (e.g. a slot) on the printer device, such that an edge of the display device is pushed into the recess so that the contacts on the printer and display devices can make contact with each other. The contacts on the display device may be planar surface contacts. The display device is not permanently connected to a printer device but is, instead, intermittently connected (e.g. hourly, daily or weekly depending on when new content is desired or available).

By using a contact based connection between the display device and a printer device, rather than a cable, the two devices can quickly and easily be connected together and disconnected and the user is not required to carry around an extra item of hardware (the cable) in order to connect a display device to a printer device. As there are no cables used, the devices are more robust (whereas cables can be broken through excessive bending/folding or being pulled away from a device). The form factor of the devices can allow for a "flush" mating rather than having protruding cable housing/sockets, and by using a contact-based connection the two devices can be smaller and in particular flatter, improving their form factor, portability and aesthetics.

As is described in more detail below, the printer device may have many different form factors but in all cases it provides one or more bias voltages (or voltage levels), e.g. one or more of the gate, source and common voltages (or voltage levels) for the electronic paper display. These voltages may be the same for all display devices or, in various examples, the printer may adjust the voltages provided for different types of display device (e.g. different electronic paper display types) or different form factors (e.g. display sizes). In some examples the printer device may provide a customized set of voltages for each display device (e.g. as identified by a unique ID). In various examples, the printer device may also provide pixel data for the display device and this may be provided via the contact based connection. In various examples, pixel data may additionally, or instead, be provided via another route (e.g. using a wireless connection such as NFC between the display device and another device).

FIG. 1 is a schematic diagram of an example display device 102 and printer device 104. The display device 102 comprises an electronic paper display 106, a processing element 108 and a contact based conductive digital data and power bus 110. As described above, the bus 110 connects the processing element 108 to a plurality of conductive contacts 112 on the exterior of the housing of the display device 102. The display device 102 does not comprise a power source and power is instead provided via the bus from a power source 125 in the printer device 104.

Figure 4:
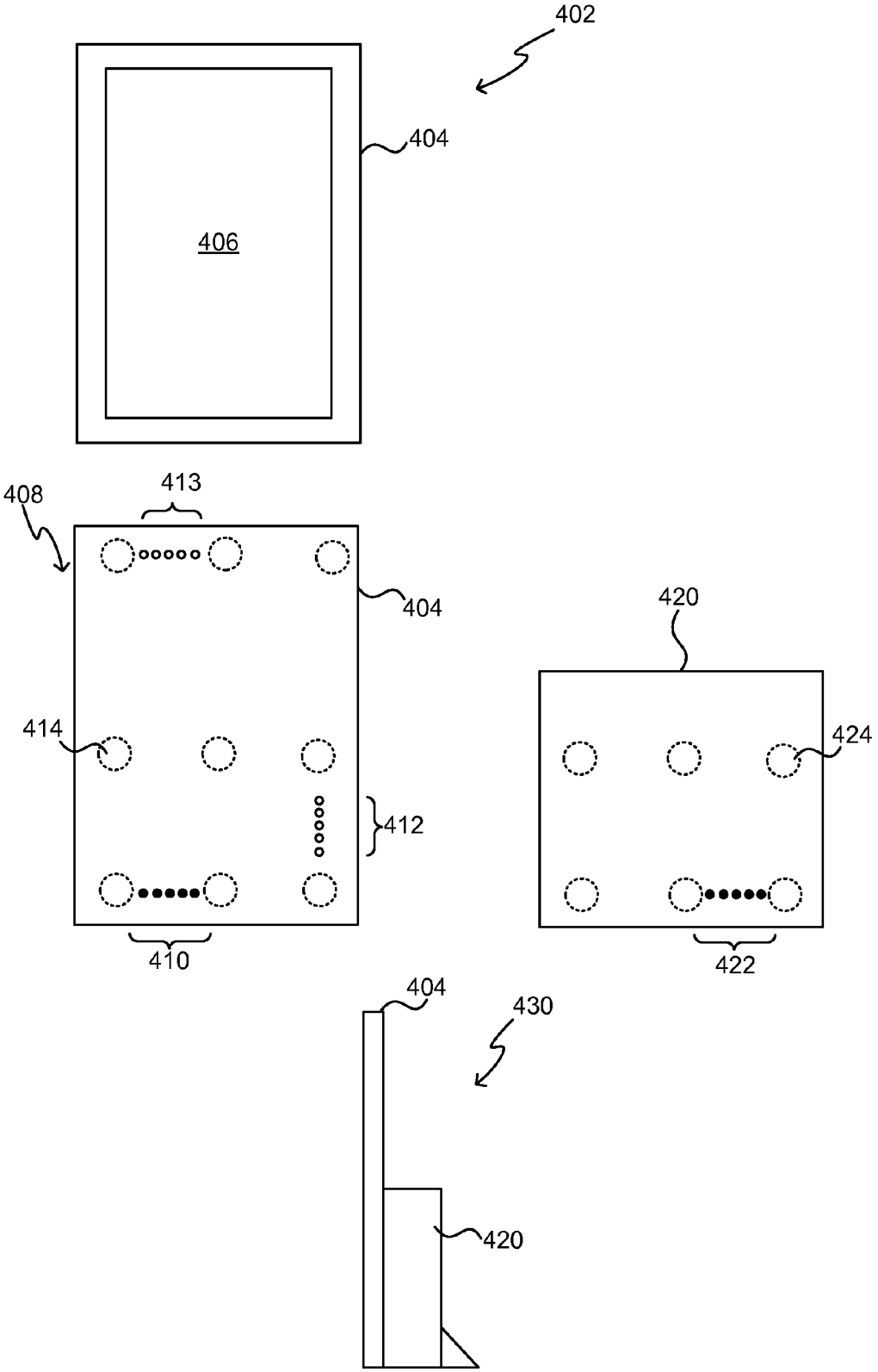
FIG. 4 shows various views of an example display device and printer device.

The electronic paper display 106 may use any suitable technology, including, but not limited to: electrophoretic displays (EPDs), electro-wetting displays, bi-stable cholesteric displays, electrochromic displays, MEMS-based displays, and other display technologies. Some of these technologies may provide multi-stable displays. In various examples, the display has a planar rectangular form factor (e.g. as shown in FIG. 4). However, in other examples the electronic paper display 106 may be of any shape and in some examples may not be planar but instead may be curved or otherwise shaped (e.g. to form a wearable wrist-band or to cover a curved object such as the side of a vehicle, a curved wall of a kiosk, or a product container). In various examples, the electronic paper display 106 may be formed on a plastic substrate which may result in a display device 102 which is thin (e.g. less than one millimeter thick) and has some flexibility. Use of a plastic substrate makes the display device 106 lighter, more robust and less prone to cracking of the display (e.g. compared to displays formed on a rigid substrate such as silicon or glass).

The processing element 108 may comprise any form of active (i.e. powered) sequential logic (i.e. logic that has state), such as a microprocessor, microcontroller, shift register or any other suitable type of processor for processing computer executable instructions to drive the electronic paper display 106. The processing element 108 comprises at least the row and column drivers for the electronic paper display 106. However, in various examples, the processing element 108 comprises additional functionality/capability. For example, the processing element 108 may be configured to demultiplex data received via the bus 110 and drive the display 106. In various examples, the processing element 108 may be configured to control or interact with other elements in the display device 102 which are not shown in FIG. 1 and this is described in more detail below with reference to FIG. 3.

In various examples the processing element 108 may comprise one or more hardware logic components, such as Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs) and Graphics Processing Units (GPUs).

In various examples, the processing element 108 may comprise (or be in communication with) a memory element 114 that is capable of storing data for at least a sub-area of the display 106 (e.g. one row and column of data for the display 106) and which in some examples may cache more display data. In various examples the memory element 114 may be a full framebuffer to which data for each pixel is written before the processing element 108 uses it to drive the row and column drivers for the electronic paper display. In other examples, the electronic paper display may comprise a first display region and a second display region that may be updated separately (e.g. the second display region may be used to show icons or user-specific content) and the memory element may be capable of storing data for each pixel in one of the display regions.

In various examples, the memory element 114 may store other data in addition to data for at least a sub-area of the display 106 (e.g. one row and column of the display). In various examples, the memory element 114 may store an identifier (ID) for the display device 102. This may be a fixed ID such as a unique ID for the display device 102 (and therefore distinct from the IDs of all other display devices 102) or a type ID for the display device (e.g. where the type may be based on a particular build design or standard, electronic paper display technology used). In other examples, the ID may be a temporary ID, such as an ID for the particular session (where a session corresponds to a period of time when the display device is continuously connected to a particular printer device) or for the particular content being displayed on the display device (where the ID may relate to a single page of content or a set of pages of content or a particular content source). In various examples, a temporary ID may be reset manually (e.g. in response to a user input) or automatically in order that a content service does not associate past printout events on a display device with current (and future) printouts, e.g. to disable the ability for a user to find out the history of what was displayed on a display device which might, for example, be used when the display device is given to another user. The ID that is stored may, for example, be used to determine what content is displayed on the display device and/or how that content is displayed (as described in more detail below).

In various examples, the memory element 114 may store parameters relating to the electronic paper display 106 such as one or more of: details of the voltages required to drive it (e.g. the precise value of a fixed common voltage, Vcom, that is required to operate an electronic paper display), the size and/or the resolution of the display (e.g. number of pixels, pixel size or dots per inch, number of grey levels or color depth), temperature compensation curves, age compensation details, update algorithms and/or a sequence of operations to use to update the electronic paper display (which may be referred to as the 'waveform file'), a number of update cycles experienced, other physical parameters of the electronic paper display (e.g. location, orientation, position of the display relative to the device casing or conductive contacts), the size of the memory element, parameters to use when communicating with the electronic paper display. These parameters may be referred to collectively as 'operational parameters' for the electronic paper display. The memory element 114 may also store other parameters that do not relate to the operation of the electronic paper display 106 (and so may be referred to as 'non-operational parameters') such as a manufacturing date, version, and other parameters.

Where the memory element 114 stores an ID or operational parameters for the electronic paper display, they may be communicated to a connected printer device 104 via the bus 110 and contacts 112 by the processing element 108. The printer device 104 may then use the data received to change its operation (e.g. the voltages provided via the bus or the particular content provided for rendering on the display) and/or to check the identity of the display device 102.

In various examples, the memory element 114 may store computer executable instructions that are executed by the processing element 108 (when power is provided via the bus 110). The memory element 114 includes volatile and non-volatile, removable and non-removable computer storage media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Therefore, a computer storage medium should not be interpreted to be a propagating signal per se. Propagated signals may be present in a computer storage media, but propagated signals per se are not examples of computer storage media.

The contact based conductive digital data and power bus 110 may be a serial or parallel bus that provides both the pixel data for the display 106 (via the processing element 106) and power to power the processing element 108 and the electronic paper display 106, as shown by the arrows in FIG. 1. As described above, the bus provides one or more of the display bias voltages (e.g. at least one of, and in some examples all three of, the following voltages: the source voltage (VS), the gate voltage (VG) and the common voltage (Vcom)) along with the logic supply voltage (Vcc) and ground (although in some examples, the same voltage may be used to drive both the electronic paper display 106 and the electronics).

The digital data and power bus 110 may, in some examples, be a multi-drop bus such that a single device printer 104 can communicate with multiple display devices 102 (without requiring dedicated connections to each display device). Where the bus 110 is a multi-drop bus, the processing element 108 listens for the data that is destined for that particular display device 102 and ignores data that is destined for other display devices. Where a multi-drop bus is used, the processing element 108 may use an ID stored in the memory element 114 to determine which data is destined for that particular display device (e.g. each display device 102 may have a unique ID) or one of the bus contacts may be a 'chip select' style signal that activates a particular display device as the destination for the data (although in this case, a per-display device chip select line may be required in addition to the shared bus).

As described above, the display device 102 physically connects to a printer device 104 without the use of wires/cables between the devices. The bus 110 connects the processing element 108 to a set of contacts 112 on the external housing of the display device. In the example shown there are five contacts 112. However, in other examples there may be different numbers of contacts 112 (e.g. three or more contacts: where only four contacts are provided these may be used for power, ground and two-wire data and where only three contacts are provided these may be used for power, ground and one-wire data).

In an example implementation there may be ten contacts 112:

- $I^2C$ data communications
- $I^2C$ data communications
- Logic supply voltage (Vcc), i.e. the power line that supplies the power for operating the digital logic in the display device
- Ground
- Common voltage (Vcom), e.g. for an EPD device a fixed voltage Vcom is applied on one side of the panel and positive or negative voltages are applied on the other side of the panel to pull or push the ink particles around (i.e. to move a pixel from one state to another state)
- Negative source voltage (VSNeg)
- Positive source voltage (VSPos)
- Positive gate voltage (VGPos)
- Negative gate voltage (VGNeg)
- Sense pin—this is used to detect the presence and removal of a display device from a printer device and can also be used to pass additional data, such as an ID for the display device to the driver electronics in the printer device (as described in more detail below).

In another implementation there may be 11 or 12 contacts and the data communications may use SPI (which requires three or four wires, with the fourth wire being the chip select which could be used to implement a multi-drop bus as described above) instead of $I^2C$ (that only requires two wires). In the event that all the voltages Vcc, Vcom, VSNeg, VSPos, VGPos and VGNeg are not provided via the contacts 112 and bus 110, they may be generated within the display device (as described below with reference to FIG. 3).

The printer device 104 comprises a set of contacts 122 that make contact with the set of contacts 112 on the display device 102 when the display device 102 is placed on (or against) the printer device 104 (although there may be different numbers of contacts on the two devices 102, 104). Consequently, the two sets of contacts 112, 122 may be described as corresponding. The contacts 112, 122 may be formed in many different ways and in some examples, the two sets of contacts may be formed differently. For example, the contacts 112 on the display device 102 may comprise fixed metallic contacts (i.e. contacts that do not move with respect to the housing of the display device 102) and the contacts 122 on the printer device 104 may be spring-loaded contacts (e.g. that use spring-loaded pins, also known as Pogo™ pins, that comprise a helical spring). By using this arrangement, with the spring-loaded contacts on the printer device 104, the display device 102 is flatter (or lower profile) and lower cost.

In various examples, the contacts 112, 122 may be arranged so that the same contact arrangement is used for multiple form factors (e.g. sizes and shapes) of display device 102 (e.g. for both an A5 and an A4 display device) and/or there may be a core set of contacts that are used for all form factors and then one or more optional contacts that may only be used for some form factors (e.g. for larger display devices).

In various examples, there may be more than one set of contacts 122 on the printer to accommodate the display device 102 being attached in different orientations (e.g. landscape or portrait) and this is shown in FIG. 4 and described below.

Figure 2:
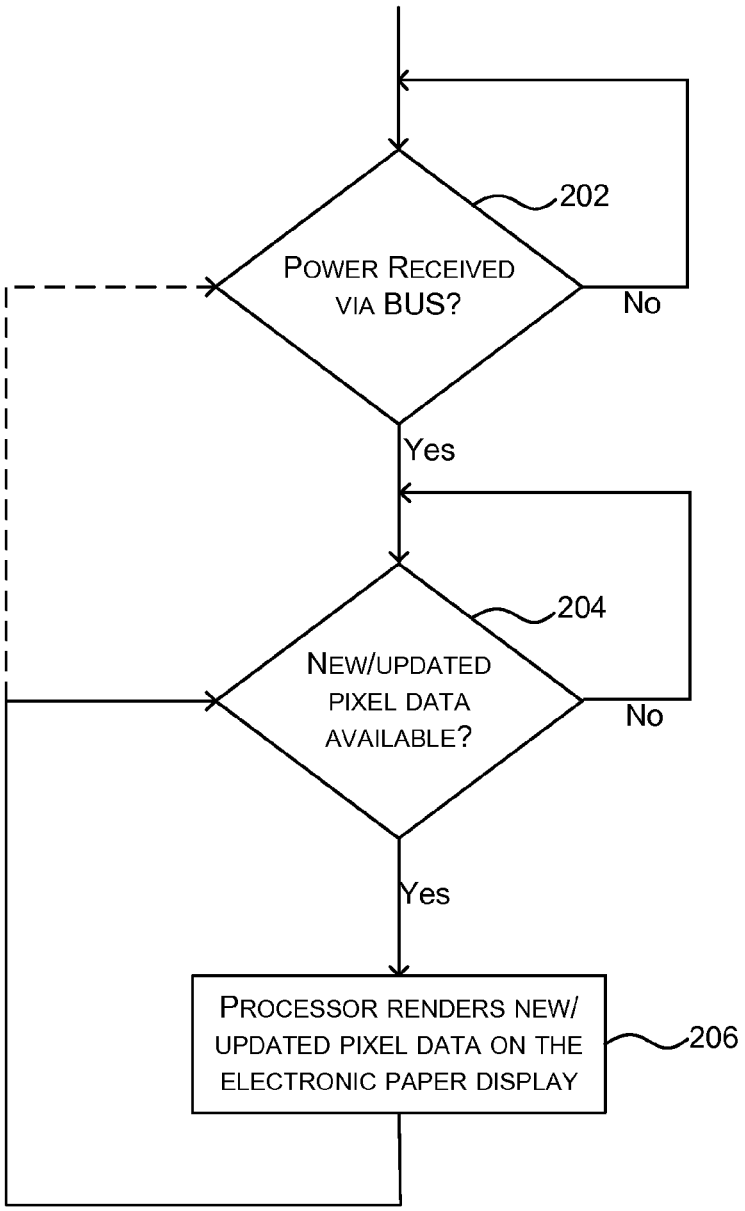
FIG. 2 is a flow diagram of an example method of operation of the display device shown in FIG. 1.

FIG. 2 is a flow diagram of an example method of operation of the display device 102 shown in FIG. 1. As described above, power for updating the electronic paper display 106 is received only via the contact based conductive digital data and power bus 110. When the display device 102 is in contact with a printer device 104, power is received via the bus 110 ('Yes' in block 202). When the display device 102 is not in contact with a printer device 104, power is not received via the bus ('No' in block 202) and the electronic paper display 106 cannot be updated.

When power is received via the bus ('Yes' in block 202) and new or updated pixel data is available ('Yes' in block 204), then this new/updated pixel data is rendered on the electronic paper display 106 (block 206). The new/updated pixel data may be received via the bus, cached by the processing element and/or received by another route (e.g. a wireless connection to a printer device, such as using NFC) and in some examples may not comprise new content but instead may be a refresh of the existing content displayed on the electronic paper display 106. The data that is received via the bus (or other route, such as NFC) is demultiplexed by the processing element. Demultiplexing is necessary because otherwise there would need to be one contact (on the display device and printer device) per row and column and as described above, the number of contacts is significantly less than this (e.g. in various examples between 3 and 12 contacts).

As shown in FIG. 2, pixel data can only be rendered when power is received via the bus ('Yes' in block 202), even if new/updated content is already available, is on because otherwise the electronic paper display does not have the power to change state (because power to update the electronic paper display is only provided via the bus and not via any other means).

Figure 3:
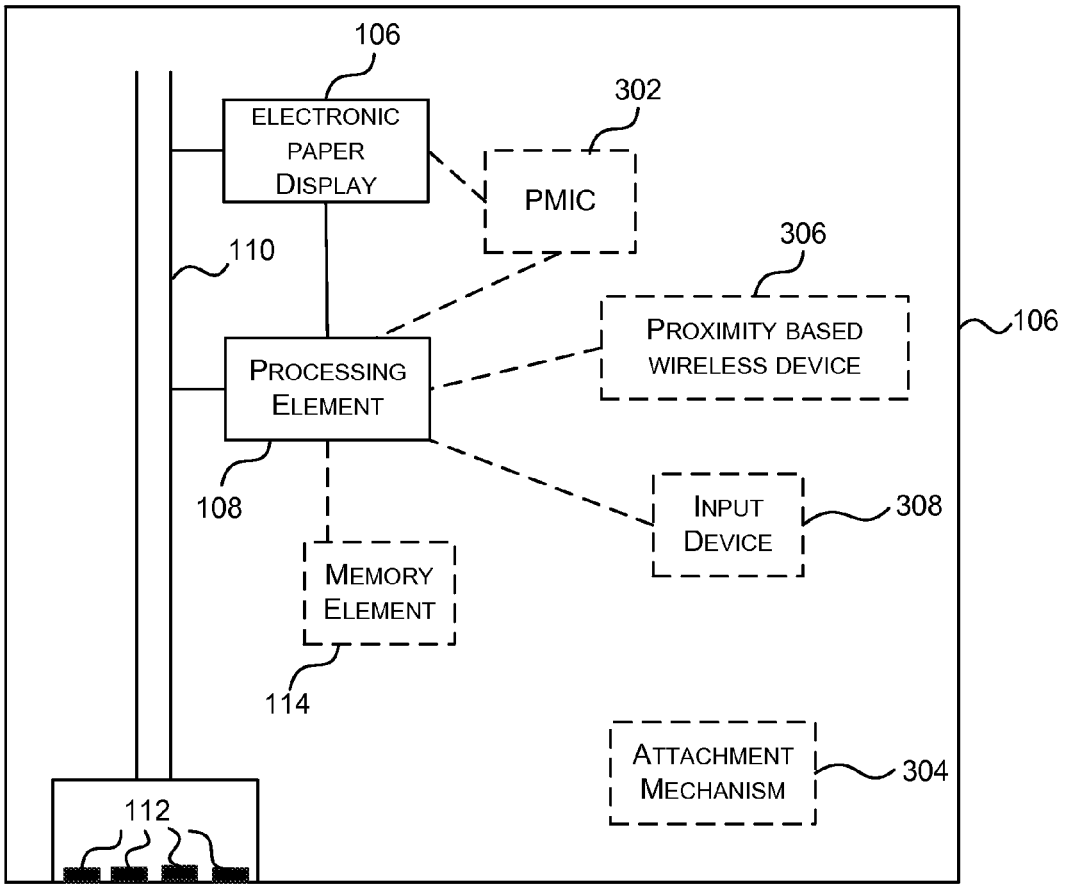
FIG. 3 is a schematic diagram of another example display device.

It will be appreciated that the display device 102 in FIG. 1 may comprise additional elements not shown in FIG. 1. FIG. 3 is a schematic diagram of another example display device 300 that comprises one or more optional elements in addition to those elements shown in FIG. 1 and described above.

In the example shown in FIG. 1, the voltages required to drive the electronic paper display 106 are all provided via the bus 110 such that there is no voltage conversion in order to generate these voltages on the display device itself. In other examples, the bus may only provide a subset of the required voltages (e.g. a proper subset of the set of voltages Vcc, Vcom, VSNeg, VSPos, VGPos and VGNeg) and some voltages may be generated within the display device 300 using a power management IC (PMIC) 302 or other voltage generation circuitry. Where a PMIC 302 or other voltage generation circuitry is provided this is not complex power supply circuitry and in particular it does not comprise any boost (or voltage step up) converters (although it may comprise linear regulators and/or buck converters).

In various examples, the display device 300 may further comprise an attachment mechanism 304 that is configured to hold the display device 300 in contact with a printer device when a user has brought the two devices into contact with each other. This attachment mechanism 304 may, for example, use one or more ferromagnetic elements in one or both of the display device 300 and the printer device. An example configuration is shown in FIG. 4 and described below. In various examples, an arrangement of ferromagnetic elements may be used that ensures that the display device 300 can only be attached to a printer device in a predefined orientation or in one of a plurality of pre-defined orientations. In addition to, or instead of, using ferromagnetic elements, the attachment mechanism may use suction cup tape, friction (e.g. with the display device being partially inserted into a slot or recess on the printer device) or a clamping arrangement.

In various examples, the display device 300 may further comprise a proximity based wireless device 306, such as a near field communication (NFC) device. The proximity based wireless device 306 comprises a data communication interface (e.g. an $I^2C$ interface, SPI, an asynchronous serial interface) and an antenna and may also comprise a memory device. The memory may be used to store an identifier (ID) that may be fixed or dynamic (or may comprise a fixed element and a dynamic element that may be stored in the same memory device or separately) and that may be read (via the antenna) by another proximity based wireless device that is in proximity to the display device 300 (e.g. an NFC reader that may be integrated within a smartphone or printer device). The ID may comprise one or more elements: an element that is fixed and correspond to an ID for the display device 300 and/or an element that is dynamic and correspond to the content currently being displayed on the display device 300 or a current session/instance ID (i.e. it may be a fixed device ID or a dynamic content ID). Where the ID (or part thereof) is a content ID or an instance ID, this may be written by the processing element 108 whenever new content is rendered on the display (e.g. following block 208 of FIG. 2). Where the ID is a session ID, this may be written by the processing element 108 at the start of each new session (e.g. when the processing element switches on in block 204 of FIG. 3). In other examples, the memory may be used to store operational parameters for the display device (e.g. as described above).

Where the display device 300 comprises a proximity based wireless device 306, this wireless device is not used to provide power to update the electronic paper display (i.e. energy harvesting is not used to provide power to update the electronic paper display).

In some examples, the display device 300 comprises a plurality of proximity based wireless devices 306. They may each have different data associated with them and the data may, for example, indicate where on the display device they are located and/or what content is collocated with that point.

In various examples, the display device 300 may further comprise one or more input devices 308. An input device 308 may, for example, be a sensor (such as a microphone, touch sensor or accelerometer) or button. Such input devices 308 are only operational (i.e. powered) when the display device 300 is in contact with a printer device 104 such that power is provided via the bus 110. Where the display device 300 comprises an input device 308, signals generated by the input device 308 may be interpreted by the processing element 108 and/or communicated to a remote processing device (e.g. in a printer device 104). User inputs via an input device 308 may, for example, be used to modify the content displayed on the electronic paper display 106 (e.g. to annotate it, change the font size, trigger the next page of content to be displayed) or to trigger an action in a remote computing device.

In an example, the display device 300 comprises an input device 308 that is a touch-sensitive overlay for the electronic paper display 106. The touch-sensitive overlay may, for example, use pressure, optical, capacitive or resistive touch-sensing techniques. When the display device 300 is powered via the bus (i.e. when it is in contact with a printer device 104), the touch-sensitive overlay may be active and capable of detecting touch events (e.g. as made by a user's finger or a stylus touching the electronic paper display 106). The output of the touch-sensitive overlay is communicated to the processing element 108 or printer device or content service that may modify the displayed image (on the electronic paper display 106) to show marks/annotations that correspond to the touch events. In other examples, the processing element 108 may modify the displayed image in other ways based on the detected touch-events (e.g. through the detection of gestures which may, for example, cause a zoom effect on the displayed content).

In another example, the display device 300 comprises an input device 308 that is a microphone. The microphone detects sounds, including speech of a user and these captured sounds may be detected by the processing element 108 or printer device or content service and translated into changes to the displayed image (e.g. to add annotations or otherwise change the displayed content). For example, keyword detection may be performed on the processing element to cause it to fetch content from memory and write it to the electronic paper display. In another example, the processing element may interpret or transform the audio data and send it to the printer device or a remote server for more complex processing. In another example, the recorded sounds (e.g. speech waveform) may be recorded and stored remotely (e.g. in a content service) associated with the ID of the display device and a visual indication may be added to the displayed content so that the user knows (e.g. when the user views the same content later in time) that there is an audio annotation for the content.

In various examples, the display device 300 may comprise a touch-sensitive overlay and a microphone that operate in combination to enable a user to use touch (e.g. with a finger or stylus) to identify the part of an image (or other displayed content) to annotate and then their voice to provide the annotation (as captured via the microphone). In such an example, the voice message may be translated to text that is added to the displayed content, or may be interpreted as a command, e.g. "delete this entry" to affect the content of the image. In other implementations, the voice message may be stored as an audio file associate with the image, and may be played back when a user activates a user-interface on the display.

FIG. 4 shows various views of an example display device 404 and printer device 420. The first view 402 shows the front face of the display device 404 that has the electronic paper display 406 that extends over nearly the entire face (i.e. all but a border region around the edge of the display device). The second view 408 shows the rear face of the display device 404 and it is this face that is contacted against a printer device. Consequently, this face comprises a plurality of conductive contacts 410 that provide the inputs to the digital data and power bus within the display device 404. In this example 5 contacts are shown along one edge of the rear face. However, in other examples there may be different numbers of contacts and/or they may be arranged differently. In some examples there may be more than one set of contacts (e.g. there may be one or more additional sets of conductive contacts 412), with different sets of contacts being positioned so that they contact the corresponding contacts on the printer device when the display device 404 is in a different orientation (e.g. sideways, upside down). In the example shown in FIG. 4, the first set of contacts 410 is used when the display device 404 is in portrait orientation, the second set of contacts 412 is used when the display device 404 is in landscape orientation (when in contact with the printer device) and the third set of contacts 413 is used when the display device 404 is in portrait orientation but is upside down (with reference to the orientation in which is drawn in FIG. 4). In other examples, the contacts may be shaped to be compatible with more than one type of contact/connector on the printer device (e.g. they may be long and thin so that they work with a slide-in connection to the printer device as well as working with spring-loaded 'pogo' pins). In some examples, the contacts may be integrated with the attachment mechanism (e.g. by using the ferromagnetic elements as the conductive contacts).

As described above, a user may touch the display device 404 against a printer device and hold the two in contact or an attachment mechanism 304 may be provided that holds the display device 404 onto the printer device once the two have been placed into close proximity (or into contact) by a user. In the example shown in FIG. 4, the display device 404 comprises a plurality of ferromagnetic elements 414.

The third view shows a printer device 420 that comprises a corresponding set of conductive contacts 422 and a corresponding set of ferromagnetic elements 424. Although FIG. 4 shows two sets of contacts on the display device and a single set of contacts on the printer device, in other examples, the printer device may comprise a plurality of sets of contacts, wherein, in use, one set of contacts is aligned (and therefore touches) the set of contacts on the display device, depending upon the orientation of the display device.

The fourth view 430 shows the display device 404 in contact with the printer device 420. In this example, the ferromagnetic elements 414, 424 hold the display device in place, such that the contacts on the two devices remain touching without a user having to hold one or both of the devices. Where an attachment mechanism 304 is used, the display device 404 and printer device 420 may connect to form a coherent physical whole (i.e. a combined unit where the printer can be picked up without the display device falling off or needing to be supported in order for the contacts on the two devices to remain in alignment).

Figure 5:
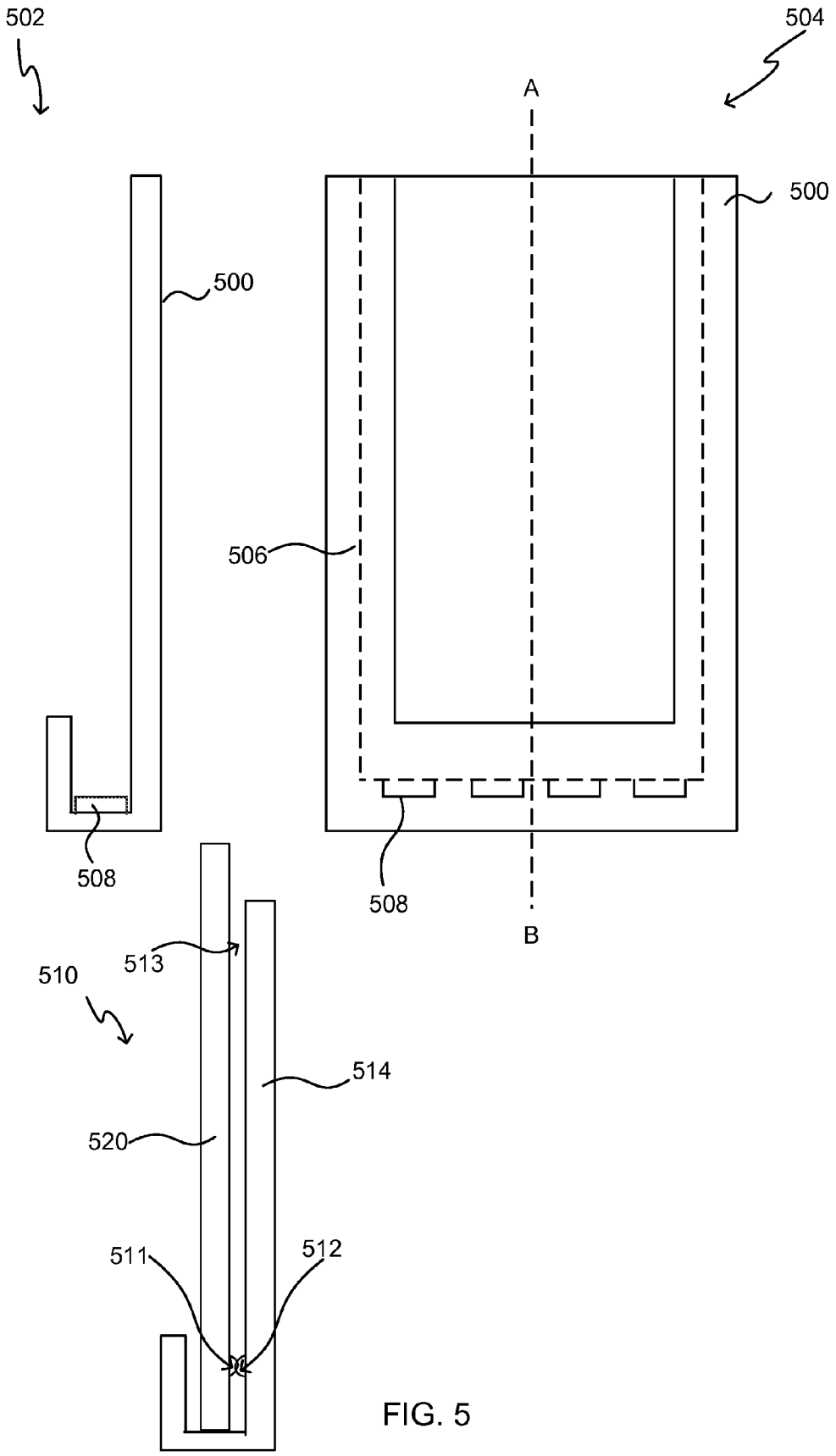
FIG. 5 shows an alternative form factor for the printer device.
Figure 7:
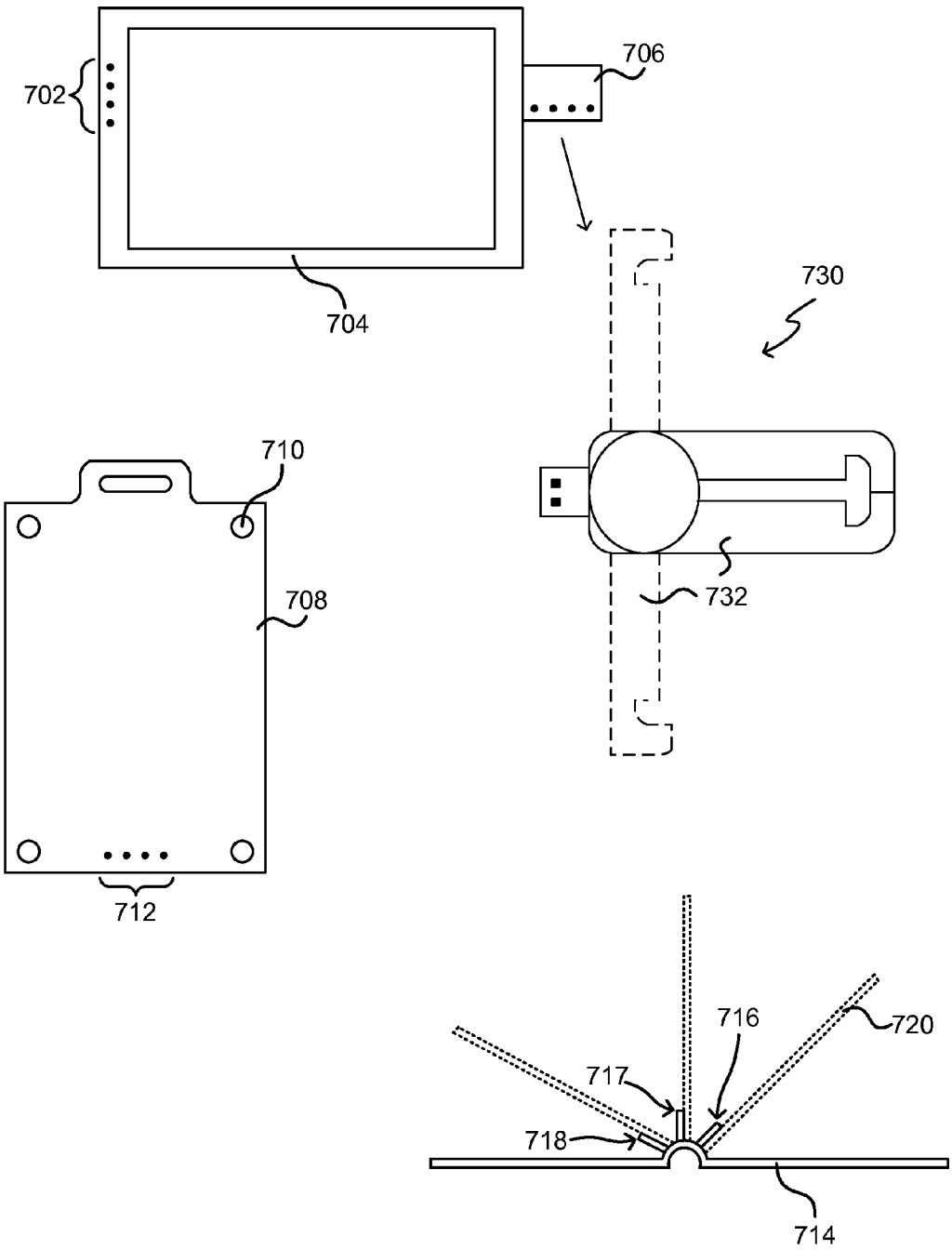
FIG. 7 shows a number of different example form factors for a printer device, such as shown in FIGS. 1 and 6.

FIG. 5 shows an alternative form factor for the printer device and further examples are shown in FIG. 7 and described below. In the example shown in FIG. 5, the printer device 500 is configured so that the display device slots into the printer device and the contacts (which are on the bottom edge of the display device) touch contacts 508 in the bottom of the slot. The first view 502 in FIG. 5 shows a cross section through the printer device 500 where this cross section is taken along the line A-B in the second view 504 which shows the front face of the printer device 500. The position of the display device when located in the printer device 500 is shown by the dotted outline 506. Alternatively, contacts as shown in FIG. 4 may still be used (e.g. with the contacts 511 being located on the rear of the display device 520 rather than on the bottom edge and corresponding contacts 512 on a front face 513 of the printer 514) as shown in the third view 510.

The printer device 104 shown in FIG. 1 comprises a plurality of conductive contacts 122, as described above and shown in FIGS. 4 and 5. Additionally, the printer device 104 comprises a power management IC (PMIC) 124 that generates the voltages that are provided to bus of the display device (via contacts 122). The PMIC 124 is connected to a power source 125 that may comprise a battery (or other local power store, such as a fuel cell or supercapacitor) and/or a connection to an external power source. Alternatively, the printer device 104 may use an energy harvesting mechanism (e.g. a vibration harvester or solar cell).

The printer device 104 further comprises a processing element 126 that provides the data for the bus of the display device, including the pixel data. The processing element 126 in the printer device 104 obtains content for display from a content source 130 via a communication interface 128. The communication interface 128 may use any communication protocol and in various examples, wireless protocols such as Bluetooth™ or WiFi™ or cellular protocols (e.g. 3G or 4G) may be used and/or wired protocols such as USB or Ethernet may be used. In some examples, such as where the communication interface uses USB, the communication interface 128 may be integrated with the power source 125 as a physical connection to the printer device 104 may provide both power and data. The content source 130 may be local to the printer device 104 (e.g. a nearby computing device such as a handheld computing device like a smartphone or tablet or a non-handheld computing device like a desktop or laptop computer).

The processing element 126 may, for example, be a microprocessor, controller or any other suitable type of processor for processing computer executable instructions to control the operation of the printer device in order to output pixel data to a connected display device 102. In some examples, for example where a system on a chip architecture is used, the processing element 126 may include one or more fixed function blocks (also referred to as accelerators) which implement a part of the method of providing pixel data in hardware (rather than software or firmware). The processing element 126 may comprise one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), Graphics Processing Units (GPUs).

Figure 6:
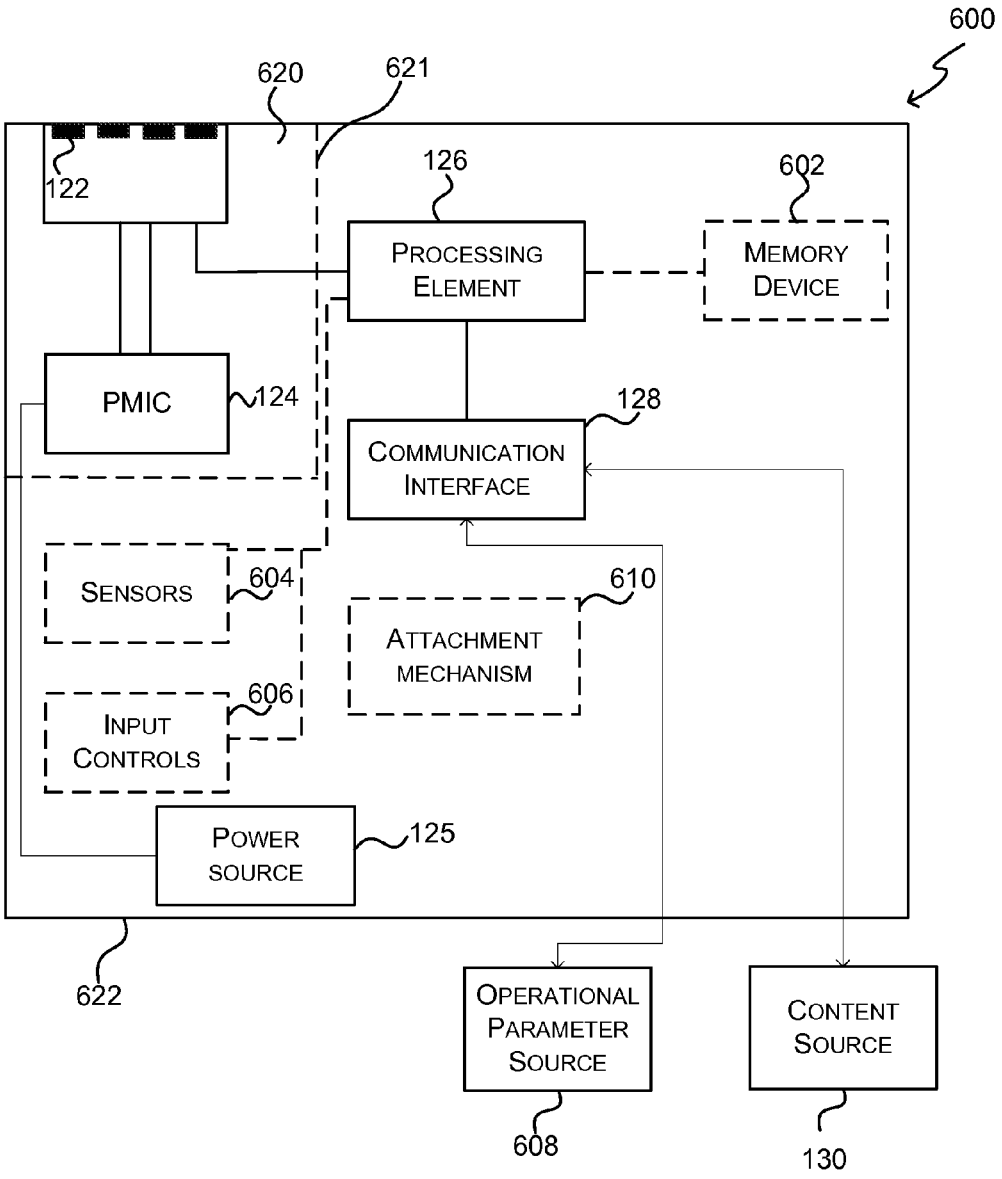
FIG. 6 is a schematic diagram of another example printer device.

It will be appreciated that the printer device 104 in FIG. 1 may comprise additional elements not shown in FIG. 1. FIG. 6 is a schematic diagram of another example printer device 600 that comprises one or more optional elements in addition to those elements shown in FIG. 1 and described above.

As described above with reference to FIG. 1, the printer device 600 comprises a communication interface 128. In addition to being used to communicate with a content source 130 to access content for display on a connected display device, the communication interface 128 may also communicate with an operational parameter source 608 that stores parameters for different display devices. Use of these parameters is described in more detail below with reference to FIG. 9.

As shown in FIGS. 4 and 5 and described above, the printer device 600 may comprise an attachment mechanism 610, such as one or more ferromagnetic elements (as in FIG. 4) or a slot to retain the display device (as in FIG. 5). This attachment mechanism 610 may, in various examples, incorporate a sensor 604 (which may be implemented as a sensing electronic circuit) to enable the printer device 600 to determine the orientation of a display device when in contact with the printer device 600 and/or whether a display device is in contact or not.

In various examples, the processing element 126 may comprise (or be in communication with) a memory device (or element) 602. In various examples, the memory element 602 may store an identifier (ID) for the printer device 600. This may be a fixed ID such as a unique ID for the printer device 600 (and therefore distinct from the IDs of all other printer devices 600) or a type ID for the printer device (e.g. where the type may be based on a particular build design or standard.). In other examples, the ID may be a temporary ID, such as an ID for the particular session (where a session corresponds to a period of time when the display device is continuously connected to a particular printer device) or for the particular content being displayed on a connected display device (where the ID may relate to a single page of content or a set of pages of content or a particular content source).

In various examples, the memory element 602 may store operational parameters for one or more different electronic paper displays, where these operational parameters may be indexed (or identified) using an ID for the display device (e.g. a unique ID or a type ID). Where operational parameters are stored in the memory element 602 these may be copies of parameters that are stored on the display device, or they may be different parameters (e.g. voltages may be stored on the display device and a waveform for driving the display device may be stored on the printer device because it occupies more memory than the voltages) or there may not be any operational parameters stored on the display device. In addition, or instead, the memory element may store parameters associated with printer device, such as its location (e.g. kitchen, bedroom) and additional connected devices (e.g. a music player through which audio can be played).

In various examples, the memory element 602 may act as a cache for the content (or image data) to be displayed on a connected display device. This may, for example, enable content to be rendered more quickly to a connected device (e.g. as any delay in accessing the content source 130 may be hidden as pages are cached locally in the memory element 602 and can be rendered whilst other pages are being accessed from the content source 130) and/or enable a small amount of content to be rendered even if the printer device 600 cannot connect to the content source 130 (e.g. in the event of connectivity or network problems).

The memory element 602 may, in various examples, store computer executable instructions for execution by the processing element 126. The memory element 602 may include volatile and non-volatile, removable and non-removable computer storage media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Therefore, a computer storage medium should not be interpreted to be a propagating signal per se. Propagated signals may be present in a computer storage media, but propagated signals per se are not examples of computer storage media. Although the computer storage media (memory 602) is shown within the printer device 600 it will be appreciated that the storage may be distributed or located remotely and accessed via a network or other communication link (e.g. using communication interface 128).

As described above, the printer device 600 may comprise a sensor 604 configured to detect whether a display device is in contact with the printer device 600 or is electrically connected via the contacts 122. In addition or instead, one or more other sensors may be provided within the printer device 600, such as an accelerometer (e.g. for sensing motion of or the orientation of the printer device 600) and/or a sensor for detecting a proximate handheld computing device (e.g. a smartphone or tablet computer).

In various examples, the printer device 600 may comprise one or more user input controls 606 that are configured to receive user inputs. These user inputs may, for example, be used to change what is displayed on a connected display device (e.g. to select the next page within a piece of content or the next piece of content). For example, the printer device 600 may comprise one or more physical buttons. In various examples, one or more physical buttons may be provided that are mapped to specific content (e.g. when pressing a particular button, a photo ID badge will always be rendered on the connected display). These buttons may have fixed functions or their functions may change (e.g. based on the content displayed or the display device connected). In some examples, the processing element 126 may render icons adjacent to each button on the electronic paper display, where an icon indicates the function of the adjacent button. In such an example, the pixel data provided to the display device (via contacts 122) is a composite image that combines the content to be displayed and one or more icons for buttons (or other physical controls) on the printer device 600.

In an example, the printer device 600 comprises an input control (or device) 606 that detects a user touching a connected display device with their finger or a stylus. This may, for example, comprise an electromagnetic sensing backplane (e.g. using electric field sensing) in the face of the printer device that is adjacent to a connected display device or may be implemented using force sensors (e.g. four sensors at the corners and where interpolation is used to calculate the touch point position) or active digitizer pens. Alternatively, optical or ultrasonic methods may be used (e.g. to look along the top surface). Where ultrasonic transducers are used, these may additionally be used to provide haptic feedback to the user. The output of the touch input control is communicated to the processing element 126 or to the content service which may modify the content and then provide the modified content to the display device (so that it is displayed on the electronic paper display 106) to show marks/annotations that correspond to the touch events. In other examples, the processing element 126 or content service may modify the displayed image in other ways based on the detected touch-events (e.g. through the detection of gestures that may, for example, cause a zoom effect on the displayed content or through provision of feedback in other ways, e.g. using audio or vibration or by selectively backlighting the electronic paper display using one or more lightpipes).

In various examples, the printer device 104 comprises an input device that is a microphone. The microphone detects sounds, including speech of a user and these captured sounds may be detected by the processing element or content service and translated into changes to the displayed image (e.g. to add annotations or otherwise change the displayed content). In another example, the recorded sounds (e.g. speech waveform) may be recorded and stored remotely (e.g. in a content service) associated with the ID of the display device and a visual indication may be added to the displayed content so that the user knows (e.g. when they view the same content at a later time) that there is an audio annotation for the content.

In various examples, the printer device 104 may comprise a sensing backplane and a microphone that operate in combination to enable a user to use touch (e.g. with a finger or stylus) to identify the part of an image (or other displayed content) to annotate and then their voice to provide the annotation (as captured via the microphone). In such an example, the spoken words may be text to add to the displayed content or commands (e.g. "delete this entry").

The printer device 600 may have many different form factors. In various examples it is standalone device which comprises a processing element 128 and communication interface 126 in addition to a PMIC 124 and a plurality of conductive contacts 122 to provide the signals for the digital data and power bus 110 within a display device. It may have any shape and in various examples may be designed to clip onto a display device (e.g. to turn it from a static display to an e-reader device, enabling a user to toggle pages using the printer) or may be permanently mounted on another device (e.g. on the steering wheel or handlebars of a vehicle to enable a user to attached and then update a display device displaying navigation instructions. The display device described herein can be viewed in sunny conditions due to the use of the electronic paper display and may be designed to be weatherproof (e.g. water resistant or waterproof), e.g. because of the use of surface contacts. In other examples, it may be a peripheral for a computing device and may utilize existing functionality within that computing device which may, for example, be a portable or handheld computing device (e.g. a smartphone, tablet computer or handheld games console) or a larger computing device (e.g. a desktop computer or non-handheld games console). Where the printing device 600 is implemented as a peripheral device, the functionality shown in FIG. 6 may be split along the dotted line 621 such that the PMIC 124 and conductive contacts 122 are within the peripheral 620 and the remaining elements (in portion 622) are within the computing device and may utilize existing elements within that computing device. In further examples, the entire printer device 600 may be integrated within a computing device or other device such as a domestic appliance (e.g. fridge, kitchen extractor unit).

FIG. 7 shows a number of different example form factors for a printer device, such as shown in FIGS. 1 and 6. In the first example, the printer device is integrated (or at least the contacts 702 are integrated) within the surround of an active display device 704 (e.g. an LED, LCD or plasma display or smartphone). In the second example, the printer device 706 (or at least the peripheral part 620, as shown in FIG. 6) is attached to the side of an active display 704 (e.g. either physically attached or connected to a USB or other connector on the display). Such a printer device 706 may have a form factor similar to a USB memory stick and may fold up so that it can be easily carried (e.g. with the contacts being protected from being damaged in the folded form), for example, on a keychain. An example form factor is shown in the larger view 730. This shows the printer device 706 when folded (with visible USB connector 731) and also (as shown by the dotted lines) when unfolded and ready to receive a display device. Ferromagnetic elements may be included within the arms 732 to assist in mating the display device and the printer device. Alternatively, a printer device may be integrated into a case for a smartphone and connect to the smartphone via micro-USB (or other electrical connection on the smartphone).

In the third example, the printer device 708 is in the form of an identity badge holder (such as may be worn around a person's neck or clipped to their clothing). As shown, the printer device 708 comprises an attachment mechanism in the form of ferromagnetic elements 710 and a plurality of conductive contacts 712. In this example, the printer device 708 is a wearable device and it will be appreciated that the printer device 708 instead be another type of wearable device (e.g. in the form of a wristband or glove). The printer device may also have non-wearable form factor, such as being integrated into a pen/stylus.

In the fourth example, the printer device 714 is capable of connecting to multiple display devices 720 at the same time and these display devices 720 are each connected along a single edge and are collectively arranged like pages in a book or ring-binder such that they have an implicit order (or arrangement) as a consequence of which tab 716-718 each display device 720 is connected to. This implicit order (in addition to IDs in each display device) may be used to determine which content to display on each display device (e.g. a first page may be rendered to a display device connected to the first tab 718, a second page may be rendered to a display device connected to the second tab 717 and a third page may be rendered to a display device connected to the third tab 716). All pages may be rendered at the same time by the printer device 714 or they may be rendered sequentially. For example, sensors in each tab or display device may be used to determine which display device is visible to the user (e.g. which "page" a user is reading) and the content may be rendered (in preparation for the user turning the "page") on the next display device in the sequence.

In the printer device 714 that connects to multiple display devices 720, the bus architecture (including the digital data and power bus 110 in each display device) supports detection and enumeration of the attached displays (e.g. using the sense pin described above).

Figure 8:
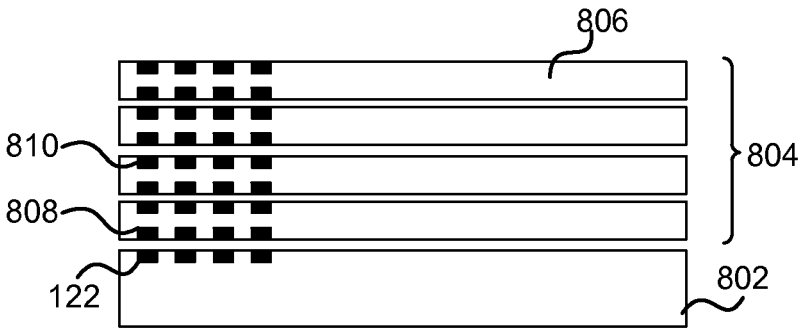
FIG. 8 shows another example arrangement of display devices and a printer device.

An alternative arrangement to that shown in FIG. 7 but which still enables a printer device to connect to multiple display devices is shown in FIG. 8. In this example, a printer device 802 connects to the first display device in a stack 804 of display devices 806. Each display device comprises a first set of contacts 808 on the rear face and a second set of contacts 810 on the front face (i.e. the face with the electronic paper display). The first set of contacts 808 is configured to contact with the contacts 122 on the printer device 802 or a set of contacts 810 on the display device below it in the stack 804. This arrangement also uses a bus architecture (including the digital data and power bus 110 in each display device) which supports detection and enumeration of the attached displays (e.g. using the sense pin described above). At least one of the sets of contacts may be designed to be compliant to improve the reliability of the connections between adjacent devices.

In the example shown in FIG. 8 the display devices 806 have an implicit order based on their position in the stack 804 and pages may be rendered at the same time by the printer device 802 on each of the display devices or they may be rendered sequentially. For example, the printer device 802 may determine (via the bus 110) which display device is at the top of the stack and then render contact on that display device only. If this display device is removed from the top of the stack by a user, content may then be rendered on the display device beneath (which is now at the top of the stack 804). In other examples, content may be rendered on both the top display device and the next display device in the sequence (e.g. in preparation for the user removing the top display from the stack).

Figure 9:
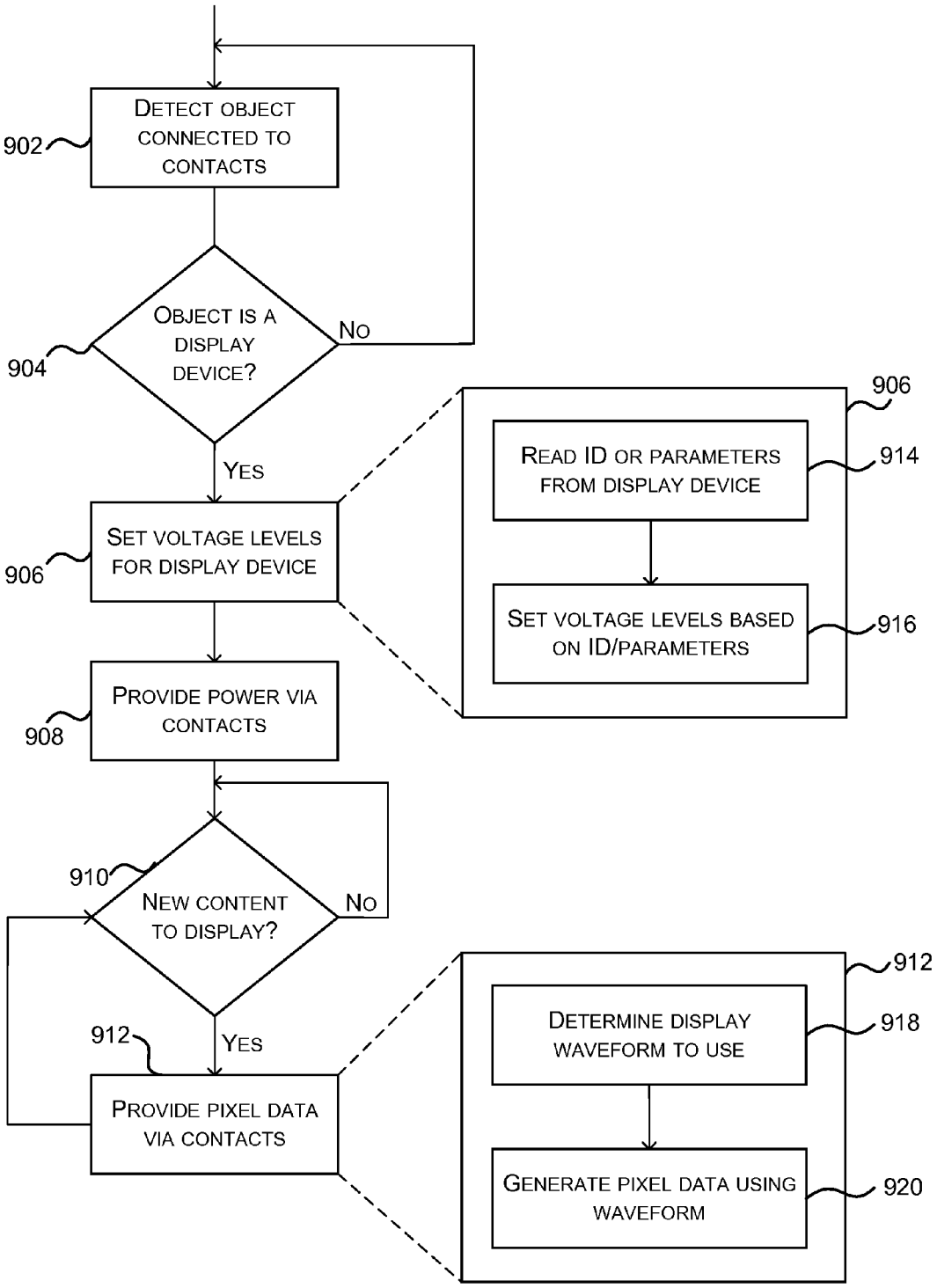
FIG. 9 is a flow diagram of an example method of operation of a printer device.

FIG. 9 is a flow diagram of an example method of operation of the printer device described above (e.g. as shown in FIG. 1 or 6). The printer device detects that an object is connected to the conductive contacts 122 (block 902) and determines whether the object is a display device (block 904). This may, for example, be determined using low current sensing (as described in more detail below). The required voltages are then only set (in block 906) if the sensing determines that the object is a display device ('Yes' in block 904). In some implementations, the same voltages may be provided to all display devices. However, in other examples, the voltage levels that are set (in block 906) are dependent upon the display device that is connected. This may, for example involve reading an ID or operational parameters from the display device (block 914) and then setting the voltage levels (in the PMIC 124) based on the ID or operational parameters that have been read from the display device (block 916).

Where an ID for the display device is read (in block 914), the operational parameters for that display device may be accessed from a local store of parameters (e.g. in memory device 602) or a remote store of parameters (e.g. operational parameter source 608 that is accessed via the communication interface 128). Where operational parameters are read from the display device (in block 914), these may be sufficient to enable the printer device to drive the display device or additional operational parameters may be accessed from a local store of parameters (e.g. in memory device 602) or a remote store of parameters (e.g. operational parameter source 608 that is accessed via the communication interface 128).

Once the PMIC 124 has set the voltage levels (in block 906), power is provided to the display device via the contacts 122, e.g. at least Vcc and ground, (block 908) and if there is new content to display ('Yes' in block 910) the pixel data for the new content can be provided to the display device via the contacts 122 (block 912) and at this point the other required voltages (e.g. Vcom) may also be provided if they have not already been provided (in block 908). As described above, in some examples the new content may be cached on the printer device (e.g. in memory device 602) and in other examples it may be accessed from the content store 130 via the communication interface 128.

In various examples, the determination of whether there is new content to display (in block 910) may involve checking the memory device 602 for new content and/or checking the content store 130 for new content. The content that is provided by the printer device may be specific to a particular display device (e.g. as identified by an ID read in block 914) and the printer device may poll the content store for new content for a particular display device (e.g. such that a display device will obtain the next piece of content identified by the content store 130 irrespective of which printer device it connects to). The content that is provided may, alternatively, be specific to the printer device (e.g. the printer device may provide the same content irrespective of the identity of the connected display device). For example, a printer device may provide a current weather forecast (as provided by the content store 130) to any display device that is connected to it.

The provision of pixel data to a display device (in block 912) may involve formatting the pixel data using a display waveform for the particular display device that is connected. The waveform may, for example, be read from the display device (in block 906) or accessed from a local store (e.g. in memory device 602) or an operational parameter store 608 based on an ID for the connected display device (as read in block 906).

As described above, determining whether the connected object is a printer device (in block 604) may, for example, using low current sensing. In an example implementation, on the printer side there is a permanent 2MΩ pull up resistor to the Vcc of the processor on the printer device, and there is a switchable 20 kΩ pull up resistor in addition, that is initially switched off when there is no display device present. On the display device side there is a permanent 200 kΩ pull down resistor from Sense to ground and both the processor on the display device and any NFC chip on the display device can also signal by pulling down hard.

If the printer device is in deep sleep and the display device is attached, the static resistors means the SENSE input to the processor on the printer device goes from Vcc to 1/11 Vcc—which is enough to trigger a digital interrupt waking the processor on the printer device from deep sleep. The processor on the printer device turns on analog input on this pin and sees that the voltage is approximately 2/22 Vcc, i.e. not a straight short to ground on the contact pins. It therefore turns on the display device's Vcc.

The processor on the display device wakes (because of the provision of Vcc) and pulls low (grounds) the sense pin once it is ready for commands. The processor on the printer device senses this grounding (via analog input) and starts communicating with the processor on the display device, which stops the grounding in response. The processor on the printer device also switches in the 20 kΩ pull up resistor, so now the SENSE bus rises to 200/220 Vcc (this is enough to be logic "high"). Now, the processor on the display device and any NFC on the display device can still signal the processor on the printer device by grounding SENSE.

Disconnection detection proceeds as before—either by polling the processor on the display device (e.g. over $I^2C$) from the processor on the printer device or by having the processor on the display device periodically wake and ground the SENSE pin to wake the processor on the printer device even from deep sleep.

Figure 10:
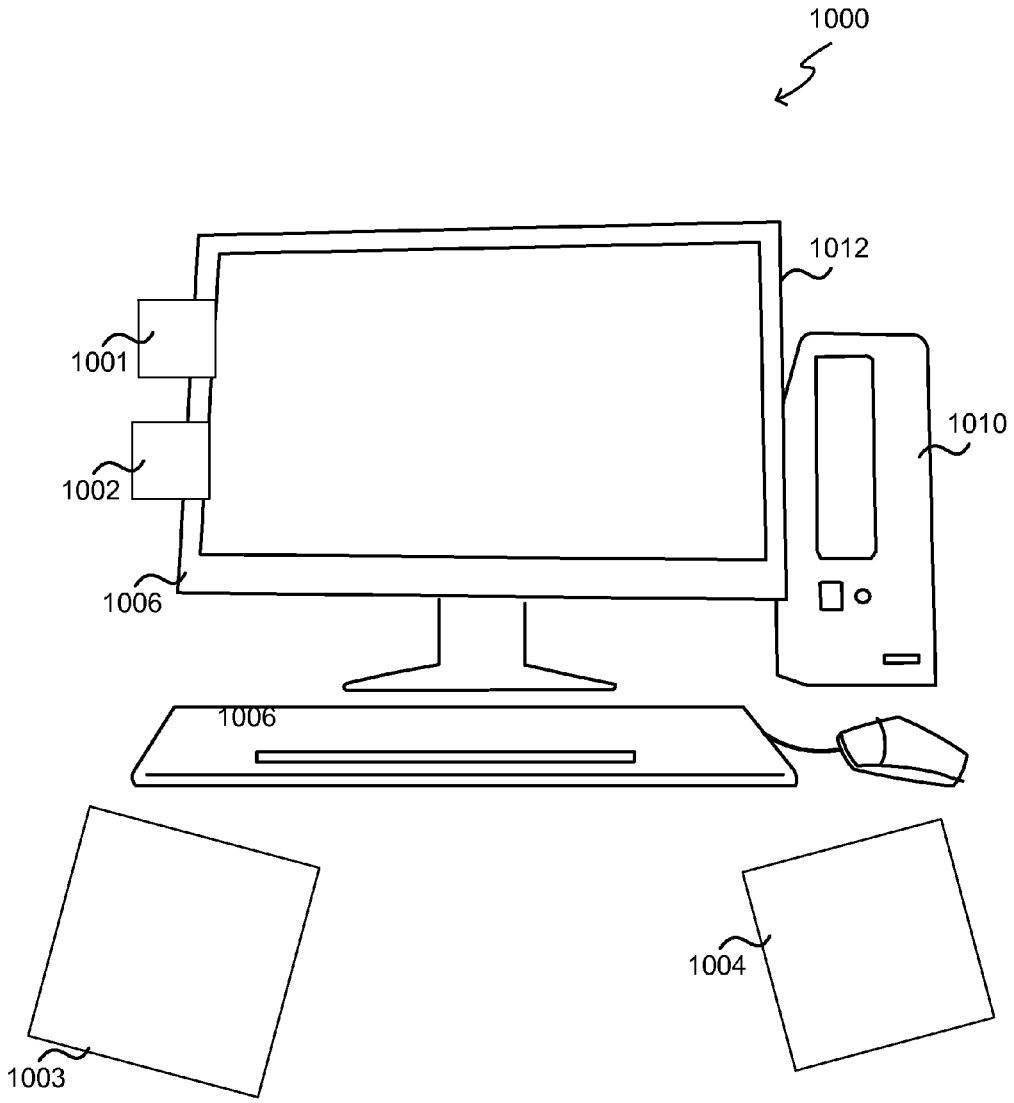
FIG. 10 is a schematic diagram showing an example desktop scene comprising a plurality of display devices.

FIG. 10 is a schematic diagram showing an example desktop scene 1000 that uses the display devices and printer devices described herein. The scene 100 comprises a number of different display devices 1001-1004 that may be used to provide persistent, yet updatable reminders (e.g. display devices 1001-1002 attached to the bezel of a computer monitor 1012) and additional reading surfaces (e.g. display devices 1003-1004 that may be on the desk surface and enable a user to read "printed" reading material without using paper or a conventional printer). The additional reading surfaces may, for example, be used for reference materials which a user may refer to over a period of time or for a diary or task list which may be updated daily or weekly. Although FIG. 10 depicts a desktop computer 1010 and peripheral monitor 1012, it will be appreciated that in other examples, the desktop computer 1010 and monitor 1012 may instead be replaced by a tablet computer (e.g. with a peripheral keyboard as part of the cover) and the display devices 1001-1004 will again provide persistent, yet updatable reminders and/or additional reading surfaces.

Although the present examples are described and illustrated herein as being implemented in a system in which content is generated remotely from the printer device, the system described is provided as an example and not a limitation. As those skilled in the art will appreciate, the present examples are suitable for application in a variety of different types of systems and in various examples, a printer device may generate content in addition to, or instead of, accessing content from a remote content store 130. Furthermore, although the systems shown comprise a single content store 130, it will be appreciated that content (and/or operational parameters) may be accessed from one or more sources (e.g. from a distributed arrangement of content stores 130 and/or operational parameter sources 608).

Furthermore, although in many of the use examples provided above, it is envisaged that the display devices are mobile whilst the printer devices may be mobile or fixed (e.g. in a static location), in other examples, a display device may be in a static location (e.g. fixed on a wall or in the dashboard of a car) and the content displayed may be updated by bringing a mobile printer into contact with the display device. For example, the display device may be used as noticeboard or advertising billboard (or hoarding) in a public space and periodically updated with new content by a user with a handheld printer device.

The display device described herein is lower cost, more robust (fewer delicate components), smaller and lighter than existing electronic paper display devices. A user does not need to charge the display device at all as power to update the electronic paper display is provided via a printer device and via direct electrical connection between contacts on the display device and the printer device.

Such devices may be particularly useful for users who are travelling and can use the display devices as screen replacements. While a user cannot easily carry around multiple screens to attach e.g. to their laptop, a display device as described herein that is attached to a printer USB peripheral can be updated every few seconds, while a display device that is detached can still be updated every few minutes, e.g. so that it displays a document that a user refers to during an hour of work. In many typical work patterns, some documents are only opened "read only" for reference, so these can be onto an infrequently-updatable display without impacting usability. In this way, the devices described herein enable mobile workers to enjoy the benefits of multiple screens while not having to carry around their associated weight. The printer devices themselves may be situated in convenient locations or even if carried, can be made small and light (e.g. in the form of a peripheral to a smartphone).

A first further example provides a display device comprising: an electronic paper display; a processor configured to drive the electronic paper display; and a digital data and power bus configured to provide pixel data for the electronic paper display and at least one externally generated bias voltage level for the electronic paper display; wherein the electronic paper display can only be updated when receiving external power via the bus.

A second further example provides a display device comprising: an electronic paper display; a contact based conductive digital data and power bus; and a processor configured to drive the electronic paper display, wherein the electronic paper display can only be updated when receiving external power via the bus.

A third further example provides a display device comprising: an electronic paper display; a digital data and power bus configured to provide at least one externally generated bias voltage level for the electronic paper display; and a processor configured to drive the electronic paper display, wherein the electronic paper display can only be updated when receiving external power via the bus.

A fourth further example provides a display device comprising: an electronic paper display; a digital data and power bus; and a processor configured to drive the electronic paper display, wherein the electronic paper display can only be updated when receiving external power via the bus.

In any of the first to fourth further examples, the display device may further comprise a plurality of conductive contacts on an exterior face of the display device and data and power bus connects the processor and the electronic paper display to the plurality of conductive contacts.

In any of the first to fourth further examples, the display device may further comprise a memory element connected to the processor and arranged to store an identifier for the display device. The identifier may be a unique identifier for the display device or for content displayed on the display device.

In any of the first to fourth further examples, the at least one externally generated bias voltage level may comprise one or more of: a gate voltage level, a source voltage level and a common voltage level for driving the electronic paper display.

In any of the first to fourth further examples, the digital data and power bus may provide all voltage levels for driving the electronic paper display, such that voltage conversion is not performed within the display device in order to drive the electronic paper display.

In any of the first to fourth further examples, the display device may further comprise a proximity based wireless device arranged to store an identifier for the display device.

In any of the first to fourth further examples, the processor may be further configured to update the identifier stored in the proximity based wireless device.

In any of the first to fourth further examples, the display device may further comprise an attachment mechanism configured to hold the display device in contact with a connected printer device. The attachment mechanism may comprise a plurality of ferromagnetic elements.

In any of the first to fourth further examples, the processor may comprise active sequential hardware logic.

In any of the first to fourth further examples, the processor may comprise row and column drivers for the electronic paper display.

In any of the first to fourth further examples, the processor may be configured, when receiving external power via the bus, to: demultiplex the pixel data received via the bus and drive the electronic paper display; and update a stored temporary identifier corresponding to an instance ID or content ID.

In any of the first to fourth further examples, the display device may further comprise an input device. The input device enables input on the electronic paper display and the input device may only provide inputs to the processor when receiving external power via the bus.

In any of the first to fourth further examples, the digital data and power bus may comprise a multi-drop bus.

A fifth further example provides a device comprising: a plurality of conductive contacts on an exterior of the device arranged to mate with a plurality of planar surface contacts on a display device; a power manager configured to supply at least one bias voltage level for an electronic paper display via one or more of the conductive contacts; and a processor configured to supply pixel data for the electronic paper display via two or more of the conductive contacts.

In the fifth further example, the processor may be further configured to: read an identifier from the display device; access one or more operational parameters based at least in part on the identifier; and modify the at least one bias voltage level and/or the pixel data using the accessed operational parameters.

A sixth further example provides a method of operating a display device, the display device comprising: an electronic paper display; a digital data and power bus; and a processor configured to drive the electronic paper display, and wherein the method comprises: receiving externally generated pixel data in the processor via the digital data and power bus; receiving at least one externally generated bias voltage level for the electronic paper display via the digital data and power bus; and only driving the electronic paper display to update an image displayed on the electronic paper display using the pixel data when receiving external power via the bus.

A seventh further example provides a method of operating a display device, the method comprising: receiving externally generated pixel data in a processor in the display device via a digital data and power bus; receiving at least one externally generated bias voltage level for an electronic paper display in the display device via the digital data and power bus; and only driving the electronic paper display to update an image displayed on the electronic paper display using the pixel data when receiving external power via the bus.

In any of the further examples described above, the electronic paper display may be a multi-stable or a bi-stable display.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include PCs, servers, mobile telephones (including smart phones), tablet computers, set-top boxes, media players, games consoles, personal digital assistants and many other devices.

The methods described herein may be performed by software in machine readable form on a tangible storage medium e.g. in the form of a computer program comprising computer program code means adapted to perform all the steps of any of the methods described herein when the program is run on a computer and where the computer program may be embodied on a computer readable medium. Examples of tangible storage media include computer storage devices comprising computer-readable media such as disks, thumb drives, memory. Propagated signals may be present in a tangible storage media (e.g. they may be stored in a tangible storage media or used in the storage process), but propagated signals per se are not examples of tangible storage media. The software can be suitable for execution on a parallel processor or a serial processor such that the method steps may be carried out in any suitable order, or simultaneously.

This acknowledges that software can be a valuable, separately tradable commodity. It is intended to encompass software, that runs on or controls "dumb" or standard hardware, to carry out the desired functions. It is also intended to encompass software that "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

The term 'subset' is used herein to refer to a proper subset such that a subset of a set does not comprise all the elements of the set (i.e. at least one of the elements of the set is missing from the subset).

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A display device comprising:

an electronic paper display with a housing;

a processor configured to drive the electronic paper display;

one or more conductive contacts on the housing of the electronic paper display configured to establish a contact-based connection with reciprocal conductive contacts on a housing of an external device wherein the one or more conductive contacts comprise a plurality of ferromagnetic elements;

a digital data and power bus configured to receive pixel data for the electronic paper display and external power for the electronic paper display, wherein the received pixel data corresponds to content selected by an external device;

wherein the electronic paper display is configured to display the selected content upon receiving the external power via the digital data and power bus through the contact-based connection established between the one or more conductive contacts on the housing of the electronic paper display being in contact with the reciprocal conductive contacts on the housing of the external device.

2. The display device according to claim 1, further comprising a plurality of conductive contacts on an exterior face of the display device and wherein the data and power bus connects the processor and the electronic paper display to the plurality of conductive contacts.

3. The display device according to claim 1, further comprising memory storing a device identifier that is a fixed identifier assigned only to the display device.

4. The display device according to claim 3, wherein the identifier is a unique identifier for the display device or for content displayed on the display device.

5. The display device according to claim 1, wherein the external power comprises at least one externally generated bias voltage level that comprises one or more of: a gate voltage level, a source voltage level, or a common voltage level for driving the electronic paper display.

6. The display device according to claim 1, wherein the digital data and power bus provides all voltage levels for driving the electronic paper display, such that voltage conversion is not performed within the display device in order to drive the electronic paper display.

7. The display device according to claim 3, further comprising a proximity based wireless device arranged to store the device identifier for the display device.

8. The display device according to claim 7, wherein the processor is configured to update the device identifier stored in the proximity based wireless device.

9. The display device according to claim 1, wherein the external device comprises a printer.

10. The display device according to claim 9, wherein the one or more conductive contacts comprise three ferromagnetic elements.

11. The display device according to claim 1, wherein the processor comprises active sequential hardware logic.

12. The display device according to claim 1, wherein the processor comprises row and column drivers for the electronic paper display.

13. The display device according to claim 1, wherein the processor is configured, when receiving external power via the bus, to:

demultiplex the pixel data received via the digital data and power bus.

14. The display device according to claim 1, further comprising an input device configured to enable input on the electronic paper display, wherein the input device only provides inputs to the processor when receiving the external power via the digital data and power bus.

15. The display device according to claim 1, wherein the digital data and power bus comprises a multi-drop bus.

16. The display device according to claim 1, wherein the electronic paper display is a multi-stable display.

17. A device comprising:

a plurality of conductive contacts on a computing device, the plurality of conductive contacts being configured to mate with other conductive contacts of a display device comprising an electronic paper display, wherein the plurality of conductive contacts comprise a plurality of ferromagnetic elements;

a power manager configured to supply at least one bias voltage level from the computing device to the display device upon detection of contact between the plurality of conductive contacts on the computing device contacting the other conductive contacts on the display device, the at least one bias voltage level causing the display device to identify the electronic paper display to the computing device through the other conductive contacts and the plurality of conductive contacts; and a processor configured to select content for the identified electronic paper display and provide pixel data corresponding to the selected content for the electronic paper display through the other conductive contacts and the plurality of conductive contacts.

18. The device according to claim 17, wherein the processor is further configured to:

access one or more operational parameters based at least in part on the device identifier; and modify the at least one bias voltage level and/or the pixel data using the accessed operational parameters.

19. A method of operating a display device comprising an electronic paper display, a digital data and power bus, and a processor configured to drive the electronic paper display, the method comprising:

providing an external computing device with a device identifier that is unique to the electronic paper display;

receiving, through a contact-based connection between ferromagnetic elements on the housings of the display device and the external device, externally generated pixel data for content selected by the external computing device based on the provided device identifier in the processor via the digital data and power bus;

receiving, through the contact-based connection, at least one externally generated bias voltage level for the electronic paper display via the digital data and power bus; and driving the electronic paper display to update an image displayed on the electronic paper display using the pixel data selected based on the provided device identifier and the externally received power via the digital data and power bus.

20. The method of claim 19, wherein the external computing device comprises a printer device.

* * * * *